US009366504B2

(12) United States Patent
Hester et al.

(10) Patent No.: US 9,366,504 B2
(45) Date of Patent: Jun. 14, 2016

(54) TRAINING AID FOR DEVICES REQUIRING LINE-OF-SIGHT AIMING

(76) Inventors: Jason S Hester, Brandon, MS (US); Henry L. Jones, II, Brandon, MS (US)

( * ) Notice: Subject to any disclaimer, the term of this patent is extended or adjusted under 35 U.S.C. 154(b) by 278 days.

(21) Appl. No.: 13/075,892

(22) Filed: Mar. 30, 2011

(65) Prior Publication Data

US 2012/0251982 A1 Oct. 4, 2012

(51) Int. Cl.
*F41G 3/26* (2006.01)

(52) U.S. Cl.
CPC ..... *F41G 3/2694* (2013.01)

(58) Field of Classification Search
USPC ..... 434/19–20
See application file for complete search history.

(56) References Cited

U.S. PATENT DOCUMENTS

| | | | | |
|---|---|---|---|---|
| 2,367,567 | A | 1/1945 | Darby | |
| 3,397,484 | A | 8/1968 | Ryan | |
| 3,691,284 | A | 9/1972 | Borjeson | |
| 3,892,352 | A | 7/1975 | Eglin | |
| 4,095,347 | A | 6/1978 | Steffan | |
| 4,534,735 | A | 8/1985 | Allard | |
| 4,561,204 | A | 12/1985 | Binion | |
| 4,606,724 | A | 8/1986 | Chanforan | |
| 4,671,771 | A | 6/1987 | LaRussa | |
| 4,917,609 | A | 4/1990 | Eichweber | |
| 5,060,391 | A | 10/1991 | Cameron | |
| 5,194,007 | A * | 3/1993 | Marshall et al. | 434/21 |
| 5,222,302 | A | 6/1993 | DeBatty | |
| 5,586,887 | A | 12/1996 | McNelis | |
| 5,716,216 | A * | 2/1998 | O'Loughlin et al. | 434/22 |
| 8,070,571 | B2 * | 12/2011 | Argentar | 463/2 |
| 8,360,904 | B2 * | 1/2013 | Oleson et al. | 473/570 |
| 2003/0131517 | A1 * | 7/2003 | Paige | 42/134 |
| 2004/0076928 | A1 | 4/2004 | Renntoft | |
| 2007/0009860 | A1 | 1/2007 | Young | |
| 2008/0144181 | A1 | 6/2008 | Pniel | |
| 2011/0001892 | A1 * | 1/2011 | Gay | 348/836 |

OTHER PUBLICATIONS

2009 BARSKA Sport Optics Catalog—Shooting Accessories—Laser Sights & Boresighter Kits, pp. 28-32, BARSKA, La Verne, CA, USA.

Bushnell Magnetic Boresighter, sold by Amazon.com, online product listing, Mar. 29, 2011.

Bushnell Deluxe Boresighter with Case and Arbors, sold by Bushnell, online product listing, Mar. 29, 2011.

Tasco Shot Saver Boresighter Riflescope Accessories, sold by Optics Giant, online product listing, Mar. 29, 2011.

* cited by examiner

*Primary Examiner* — Sam Yao
*Assistant Examiner* — Evan Page
(74) *Attorney, Agent, or Firm* — Joseph S. Bird, III; Bradley Arant Boult Cummings LLP

(57) ABSTRACT

The present invention is a novel apparatus for use as a training aid for devices that are aimed using line-of-sight methods, such as firearms and telescopes. A need exists for a removable aid that will improve the various aspects of targeting and device handling by the trainee. The present invention satisfies this need by placing a small, high-resolution electronic display within the line-of-sight of a device and adding other electronics to drive the display. The display and the additional electronics are used to provide many functions that are useful in training.

38 Claims, 6 Drawing Sheets

TRAINING AID FOR DEVICES REQUIRING LINE-OF-SIGHT AIMING

FIELD OF THE INVENTION

The present invention is a novel apparatus for use as a training aid for devices that are aimed using line-of-sight methods, such as firearms and telescopes.

BACKGROUND OF THE INVENTION

The present invention should be used in any environment where training is desired regarding the aiming and utilization of a device that requires manual line-of-sight aiming. For example, hunters of wild game may not be afforded the opportunity to see many live game animals through the scope of their firearm prior to a hunt. The invention described here may show images of possible targets, such as game animals at various distances, so that the hunter can learn to accurately estimate the distance to a target based on its size as it appears through the firearm's optical sight. The quality of the game animal is also important when deciding whether or not to shoot, so this invention allows animals of various hunt quality to be shown to new hunters prior to a hunt, to lessen the chance of poor decision making in the field. In addition, the hunter may wish to measure the motions required to raise and steady the firearm and improve these motions through training, and this invention provides for data about these motions to be collected for use in such training.

SUMMARY OF THE INVENTION

The present invention satisfies these needs by placing a small, high-resolution electronic display within the line-of-sight of a device and adding other electronics to drive the display. This display, mounted as appropriate to a firearm or other device, would require electronics infrastructure components including, but not limited to, a microprocessor, a set of software instructions, data storage, a power supply, and a means of control by the user (and collectively referred to herein as "basic electronic components" or "electronics infrastructure").

Moreover, a wide variety of additional possible training uses for the invention become available once this electronics infrastructure is in place. Movies can be shown instead of still images, and various target families can be interchanged easily by replacing the a removable data storage device. With the addition of small accelerometers and gyroscopes, the motion of the device can be determined and this information can be used to modify the image or it can be recorded for analysis of the user's aiming technique. Wired or wireless communication from the device to other computer systems can open up the device to even more uses as a sensor and display platform on the firearm.

FIG. 1 illustrates the general relationship between the training aid 101 and the device to be aimed, in this case a firearm 1. The firearm 1 is a pre-existing device which is not a part of the invention, and is shown in FIG. 1 in its unimproved and unaltered form. The training aid 101 is mounted to the barrel 2 of the firearm 1 using a simple mounting mechanism 110 with its electronic components contained in an enclosure 120. A trainee may hold the firearm 1 as normal, and look through its optical sight 3 in its normal manner, and view the electronic display 102 of the training aid 101 through said optical sight 3.

In the basic configuration of the invention, illustrated schematically in FIG. 2A, the microprocessor 103 serves as the central hub for communication between the other electronic components electronic display 102, user control 104, power supply 105, and data storage 106. The software instruction set is stored in internal memory 108. The microprocessor 103 serves as the central hub of information, providing output to the electronic display 102 using instructions from the display driver integrated circuit 107 gathering data from its onboard memory 108 as well as from a data storage 106 device, and reacting to input from the user control 104, all subject to the guidance provided in the onboard set of software instructions. In an exemplary schematic of the invention with additional training capability, illustrated in FIG. 2B, the built-in serial ports 109 of the microprocessor 103 are used to communicate with an optional wireless radio 211, an optional means of wired communication 212, an optional set of acceleration sensors 213, and an optional set of velocity sensors 214. The components which can be connected to the microprocessor 103 are not limited to the quantity (i.e., 4) or to the ones identified, but they are represented in this configuration only as examples.

Due to the wide variety of microelectronic components now commercially available, the configurations shown in FIGS. 2A and 2B may be implemented using a wide variety of physical embodiments. Microprocessors are sometimes packaged in integrated modules with the other components, particularly wireless radios, data storage, and environmental sensors. Other commercial products may combine the electronic display and a power supply with the other electrical components to provide an "all in one" package for use within the invention. In some cases, it may be beneficial to use commercial products that provide a full set of integrated hardware described in these configurations, distributed with standardized software that provides for programming at a high abstraction layer, as versatile platforms for constructing the invention. As long as the package of electronic components can be arranged in such a way as to successfully present the electronic image to the trainee in the appropriate manner, the intention of the invention is achieved.

One example of a particularly useful hunting application for the invention is for individuals who are hunting an animal species for the first time. For example, a white-tailed deer hunter may be accustomed to targets that are roughly four feet tall at the shoulder, and thus the hunter learns over time the accurate distance to the target if it takes up a given size in his optical sight. If that same hunter were to go moose hunting, this animal with a shoulder height of seven feet might appear to be at the same distance but would actually be much further away. Being able to estimate the correct distance allows the hunter to compensate appropriately when taking a shot. Consequently, this training aid allows a hunter to approach such a hunt with greater confidence. The invention also allows a hunter to take a gun and sighting apparatus that he has never used before and, before spending any time in the field, learn to recognize the distance to a game animal based on its size in the sighting apparatus.

Another example of a useful recreational application for the invention is for individuals who are not able to use a live firearm, but want to improve their weapons handling skills. The invention allows a trainee to practice raising, aiming, and steadying the weapon from a rest position and to use a comparison of the recorded results from the acceleration and velocity sensors to see the effect of his practice through improvements in these actions (e.g., higher acceleration and velocity while raising the weapon, and lower acceleration and velocity while holding the weapon steady) over time.

Such a training aid is not limited to long-barreled firearms such as rifles and shotguns, as an appropriately-constructed enclosure 120 and mounting mechanism 110 could enable the use of the same or similar components for training in the use of archery bows, telescopes, binoculars, and any other devices that utilize line-of-sight aiming.

BRIEF DESCRIPTION OF THE DRAWINGS

These and other features, aspects, structures, advantages, and functions are shown or are inherent in, and will become better understood with regard to, the following description and accompanied drawings where.

DETAILED DESCRIPTION OF THE PREFERRED EMBODIMENTS

Figure 1:
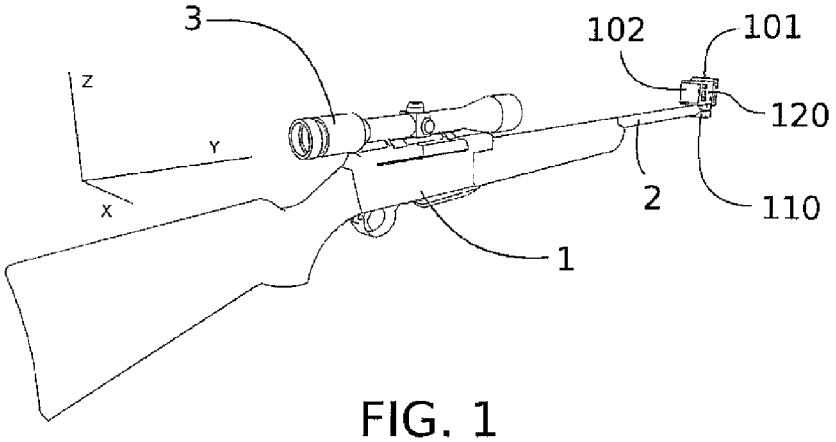
FIG. 1 is an overall view of a use of the training aid with a firearm in accordance with the invention.

While embodiments of this invention can take many different forms, specific embodiments thereof are shown in the drawings and will be described herein in detail with the understanding that the present disclosure is to be considered as an exemplification of the principles of the invention and is not intended to limit the invention to the specific embodiment illustrated.

Figure 3A:
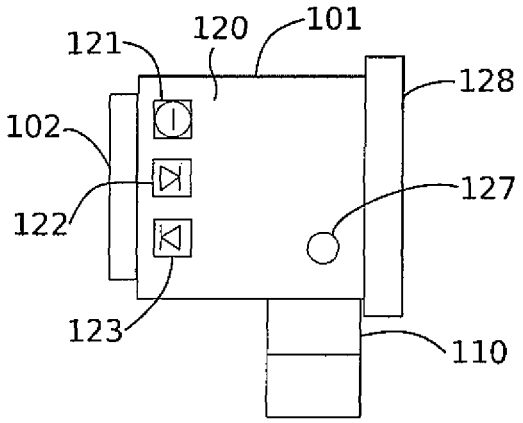
FIGS. 3A, 3B, and 3C are side, front, and perspective views, respectively, of the training aid shown in FIG. 1 in which the device is a first embodiment as shown in FIG. 2A.
Figure 3B:
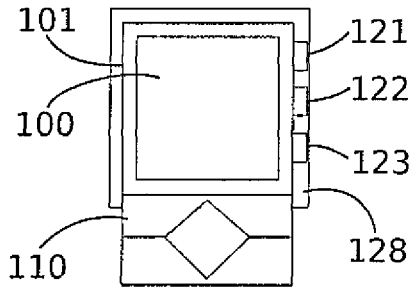
Figure 3C:
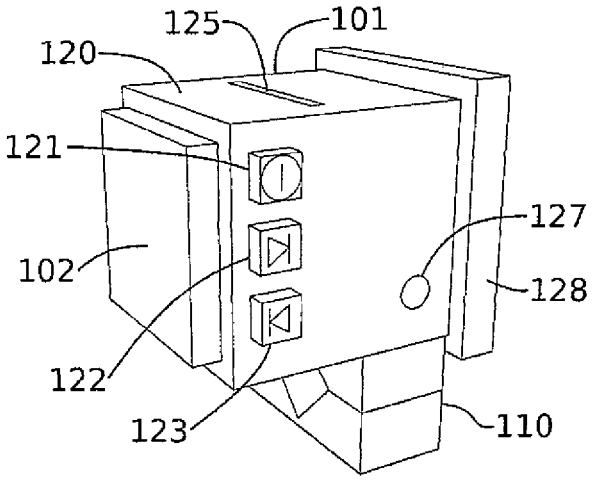

FIGS. 3A, 3B. and 3C. In one embodiment of the invention, illustrated in FIGS. 3A, 3B, and 3C as the side, front, and perspective views, respectively, the basic electrical components of the training aid 101 are contained in one enclosure 120 that is attached to the mounting mechanism 110. The basic electrical components visible in these figures include an electronic display 102, user controls 121, 122, and 123, access slot 125, and power receptacle 127.

The manipulation of images on the electronic display 102 is carried out by microprocessor 103 (inside the enclosure 120) according to a set of software instructions (not shown). As used throughout this application, a "microprocessor" is a device that incorporates all or most of a computer's central processing unit in a single integrated circuit. A representative microprocessor which can be incorporated into the invention is the Texas Instruments OMAP3530, which has substantial internal memory and display driver capabilities.

The utility of the training aid is made possible by its small size and low cost, which was only recently made possible through the mass commercialization of small, high-resolution electronic displays such as liquid crystal displays (LCDs) for use in cameras, phones, and other consumer products. As used herein, a "display" is a device that transforms digital signals into a two-dimensional image format. One can readily see that any display technology that provides high resolution electronic displays would be a proper choice for this invention. The display could provide two-dimensional images or movies or, as 3-D digital technology matures, three-dimensional images or movies. In another embodiment, more than one electronic display may be utilized to provide stereoscopic displays to the trainee. Multiple electronic displays may also be utilized to show an image in one or more electronic displays and environmental or training aid performance data from sensors, status of the training aid software, or other ancillary information in the additional electronic displays. Because the display may be used with the naked eye as well as with infrared scopes or sensors, a display used in this invention may be required to provide a wavelength range of 390 to 15000 nm. As presentations of natural scenes are a highly desirable goal of the invention, a broad range of light frequency is preferred in the electronic display. A narrow band of wavelengths for the electronic display (e.g., less than 80 nm) would therefore be beyond the scope of this invention. A representative display is the Kopin CyberDisplay SVGA LV, which provides an 800 pixel by 600 pixel image in an array 0.59" measured diagonally and provides images within the 'visible' wavelength range of 425 to 725 nm. The invention, in other embodiments, may utilize a display which is sensitive to touch such that the electronic display also acts as the user interface control or complements the user interface control.

The training aid has some number of user interface controls, such as the three buttons 121, 122, and 123 of this embodiment. In this embodiment, the Power toggle user interface control 121 is used by the trainee to turn on and turn off the training aid. The Next user interface control 122 is used by the trainee to indicate to the microprocessor 103 that the next element in the training, as defined by the set of software instructions, should begin. The Previous user interface control 123 is used by the trainee to indicate to the microprocessor 103 that the previous element in the training, as defined by the set of software instructions, should begin or the current training element should be restarted.

The microprocessor 103 may have sufficient data storage within the microprocessor module for all the memory needs of the training aid, or it may utilize internal memory 108 for some requirements and utilize external data storage 106 for others. As used herein, "data storage" means a device or multiple devices for recording, storing, and providing data. The data storage 106 may be a removable memory card 124 (see FIG. 5) that is accessed by an access slot 125. In other embodiments, the data storage could be provided by any of a number of data storage technologies, ranging from internal solid-state memory, to removable storage cards of various formats, to micro hard drives, among others. In addition, other embodiments could use a plurality of data storage devices, much like some digital video cameras such as the Sony SDR-12 have internal camera memory, a removable storage card, and a micro hard drive.

The training aid in this embodiment is powered by a battery 126 (see FIG. 5), which can be recharged via a supply of power to receptacle 127 or by removing the battery cover 128 and replacing the battery 126. Although part of the utility of the training aid is its small size and portability, prolonged use may require more power than a battery could readily provide. Therefore, the power supply to the aid may be a battery as in the battery 126 in FIG. 3 or it could be provided by an external source through a power cord to power receptacle 127.

Designers of boresighters for weapons have invented a number of methods of attaching a boresighter to a weapon which may be utilized by this invention for mounting the training aid to a device. These methods include a magnetic fitting to the end of a firearm barrel, a pressure fitting on the outside of the firearm barrel, and an insert that slides into the firearm barrel. In each of these methods, a material benefit to the designer and the user is that no modifications of any kind to the firearm are necessary. Such a variety of mounting mechanisms would be available for use in this invention, including the external pressure fit mounting mechanism 110 shown in FIGS. 1, 3A, 3B, 3C, 4A, 4B, 4C, and 5. Other possible methods for attaching the training aid which may be more appropriate depending on the nature of the device being aimed include a hook-and-loop fastener or an elastic, plastic, or metal band. The arrangement of the invention requires that all the components, and the display and mount in particular, be constructed in such a way that the trainee has an unobstructed view of the training aid display. Therefore, this arrangement is likely to be different for different devices.

The data storage 106 may contain images or movies, and the microprocessor 103 may show those images or movies on the electronic display 102 according to the capabilities of the software instruction set.

The training aid can be configured to be useful with whatever sighting mechanism is used by the device, such as an iron sight, telescopic sight, or reflex sight, among others. Iron sights exclude the use of optics and typically use a pair of simple component sights: a rear sight consisting of some form of notch or aperture and a front sight constructed from a bead, post, or slot. For an iron sight, the electronic display 102 can be positioned such that the image is in view for the trainee beyond these iron sight components. A telescopic sight uses lenses and mirrors to provide telescopic power, and reflex sights use lenses and mirrors to reflect reticle images onto a combining glass for superimposition on the target. For these optical sights, the electronic display 102 can be positioned such that the image is seen through the optics of the sight.

Figure 4A:
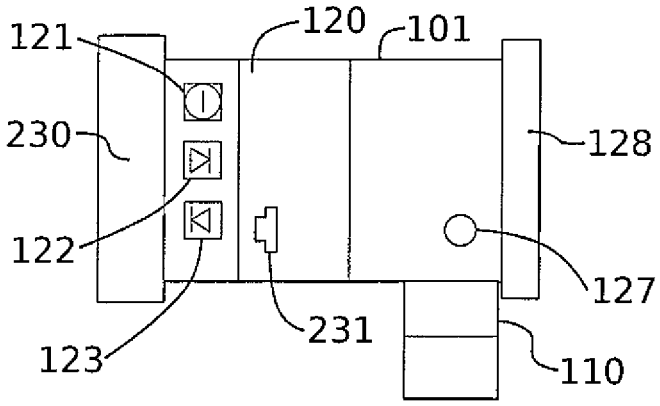
FIGS. 4A, 4B, and 4C are side, front, and perspective views, respectively, of the training aid shown in FIG. 1 in which the device is a second embodiment with additional electrical components as shown in FIG. 2B.
Figure 4B:
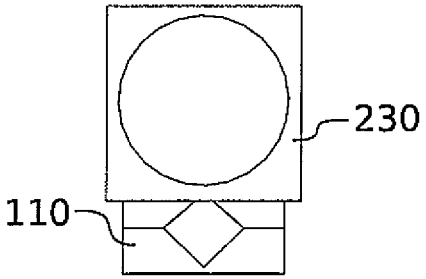
Figure 4C:
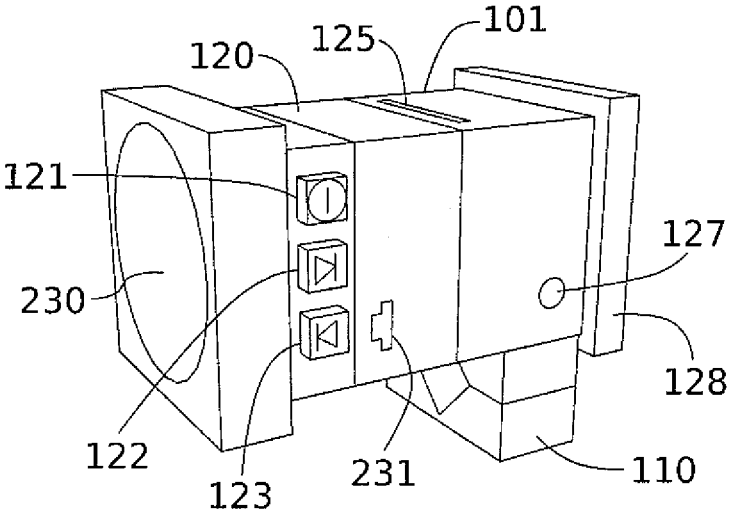

FIGS. 4A, 4B, 4C. In another embodiment of the invention, illustrated in FIGS. 4A, 4B, and 4C as the side, front, and perspective views, respectively, additional components are added to the basic configuration to provide additional functionality to the trainee. These optional components may be added individually to the basic training aid shown in FIGS. 3A, 3B, and 3C or may all coexist with one another in an embodiment as shown in FIGS. 4A, 4B, and 4C. The additional components visible in these include a set of optical components 230 and a receptacle 231 for receiving a wired connection 212 (not shown).

Figure 5:
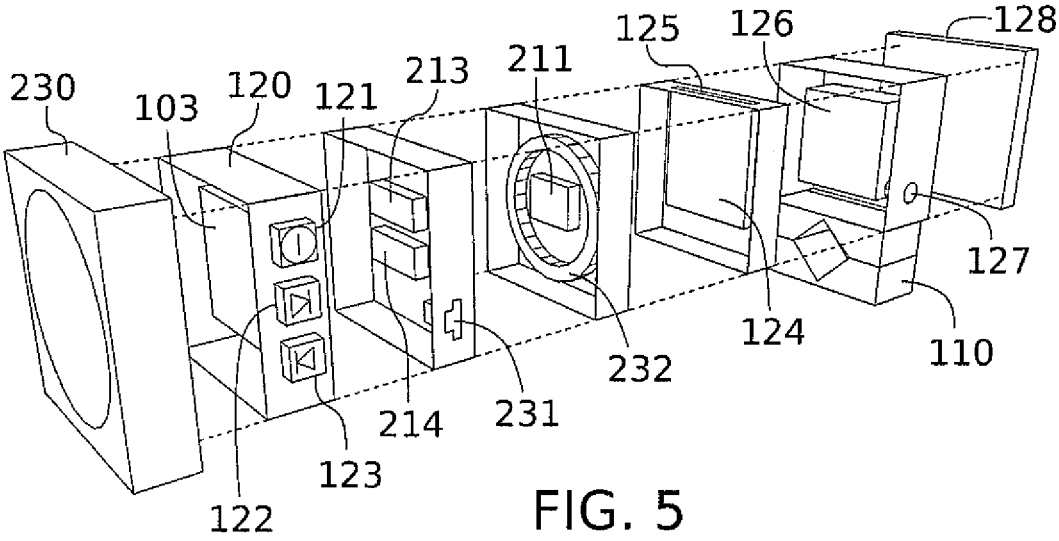
FIG. 5 is an exploded perspective view of the second embodiment with additional electrical components as shown in FIG. 2B so that the interior of this embodiment of the training aid may be more readily viewed.

FIG. 5. An exploded perspective view of this embodiment is illustrated in FIG. 5. In this embodiment, a set of optical components 230 is attached to the enclosure 120 in which the microprocessor 103 is held. The user control buttons 121, 122, and 123 are attached to the outside of the enclosure 120. The acceleration sensors 213 and velocity sensors 214 are also inside the enclosure 120, located near the receptacle 231 for receiving a wired connection 212. The wireless radio 211 is contained in the enclosure with its antenna 232. The access slot 125 provides for the insertion and retrieval of the removable memory card 124 from the enclosure 120. The battery 126 and power receptacle 127 are located near the rear of the enclosure 120 next to the removable battery cover 128.

A set of optical components 230 may be added as an assembly to the front of the training aid 101 to accommodate any necessary optical manipulation of the image. If a high-powered telescopic sight is installed on the firearm, some manipulation of the optical power may be necessary to bring the image on the electronic display 102 into proper focus. The set of optical components may be fixed such that only one focal distance is available, or the components may be adjustable to provide a range of focal distances. For example, if a telescopic sight mounted to a firearm may be adjusted to provide a range of magnifications from 2× to 10×, a trainee may wish to practice the adjustment of this telescopic sight while viewing a target. To make this training step possible, the set of optical components attached to the training device could be adjusted to reduce the effective magnification to different levels as appropriate for the training exercise.

Because the training aid includes a microprocessor 103, a straightforward step is to integrate one or more acceleration and velocity sensors 213 and 214, respectively, to capture motion about one, two, or three translational axes and about one, two, or three rotational axes. For instance, an acceleration sensor 213 mounted in such a way as to measure accelerations of the end of a firearm in the direction parallel to the ground and perpendicular to the barrel (hereafter called the 'X axis' and shown in FIG. 1) would indicate movement of the end of the barrel along that axis. However, if the training aid were using this information alone it would not be able to distinguish between a purely rotational motion of the firearm about the axis perpendicular to the ground (hereafter called the 'Z axis' and shown in FIG. 1) and a translation of the entire firearm along the X axis; this distinction is necessary to give the microprocessor 103 the ability to direct the images in the electronic display 102 in accordance with the actual movement of the device, which can be moved in any direction, unlike a device affixed to or pivoting about a single location. To make such a distinction, a gyroscope (a type of velocity sensor 214) placed along the Z axis provides information regarding whether the movement was rotational or not, allowing the training aid to determine whether the movement was translational, rotational, or some combination of both.

These sensors measure the rotational and translational movements of the training aid 101, as discussed in the preceding paragraph, for various purposes. One purpose, as in the embodiment shown in FIG. 1, would be to measure the movement of the end of the rifle while it was being aimed by the trainee. Measurements of translations and rotations about a single point can be used by the trainee or an instructor to examine how much movement exists when the firearm is being aimed by the trainee at a fixed target, when zero movement is desired. This invention also enables the measurement of much more complex movements, such as the compound action of raising a firearm to shoulder level from a rest position, leveling the barrel, and eliminating all motion, among other complex motions and actions. Complex movements such as the aforementioned "raise, level, and steady" consist of translations of the firearm along multiple axes, and rotations of the firearm along multiple axes, which require multiple acceleration or velocity sensors and specific software instructions to track and calculate these movements. Information regarding these movements is shown on the electronic display 102, stored on the data storage 106, or sent to another computer via a communication means as described below. The sensor information may be used over time to study the trends in the trainee's performance, and it may be used in comparison with other trainees for comparative or competitive purposes. This method of use can optionally be carried out without the utilization of a target image in the display.

Another possible use of the acceleration and velocity sensors 213 and 214 in an embodiment such as FIG. 1 is to manipulate the image on the electronic display 102 due to measurements of the movement of the end of the firearm 1. For example, a still image may be made to appear as if it were fixed in inertial space by moving the image to the right if the sensors detect a translation to the left, by moving the image up if the sensors detect a translation down, by making the image larger if detecting a translation toward the target, and so on in proportion to the amount of the sensed movement. Similarly, the still image may be rotated on the screen if the sensors determine that the firearm is being rotated about the axis along the barrel (the Y axis shown in FIG. 1). As stated above, such motions of the image require multiple sensors arranged such that distinctions between translations and rotations of the training aid, and therefore the device, can be made. Not only may the movement information be saved for later analysis, this feedback to the trainee via the moving image allows the trainee to immediately understand how the movement of the end of the firearm 1 results in actual target movement in the optical sight 3. Movies are handled by the microprocessor in the same way. Other types of sensors, such as temperature, ambient noise, or barometric pressure may also be considered for inclusion in the training aid.

Figure 2A:
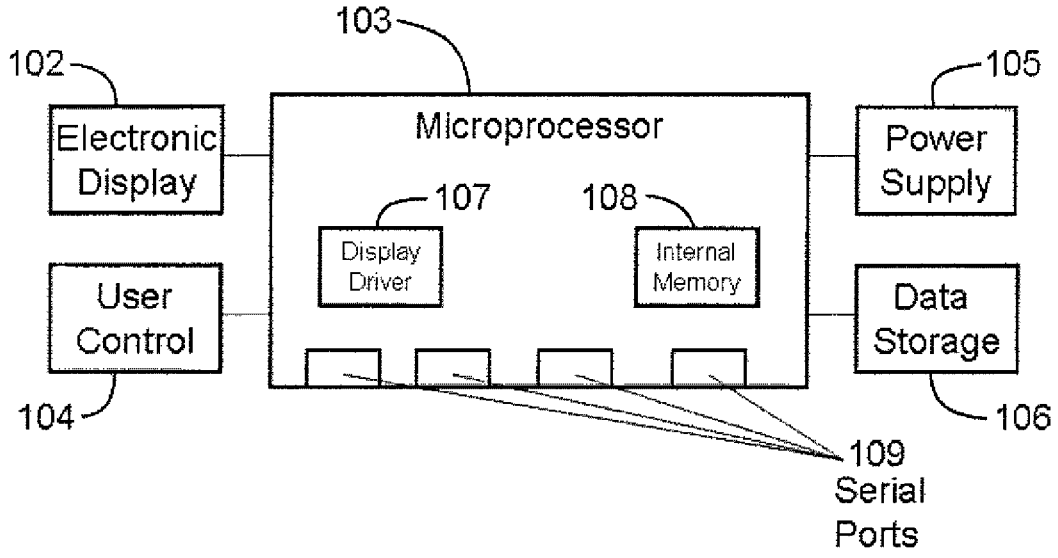
FIG. 2A is a block diagram showing the relationship between the electronic components in a first embodiment of the invention and FIG. 2B is a block diagram showing the relationship between electronic components in a second embodiment of the invention with additional features.
Figure 2B:
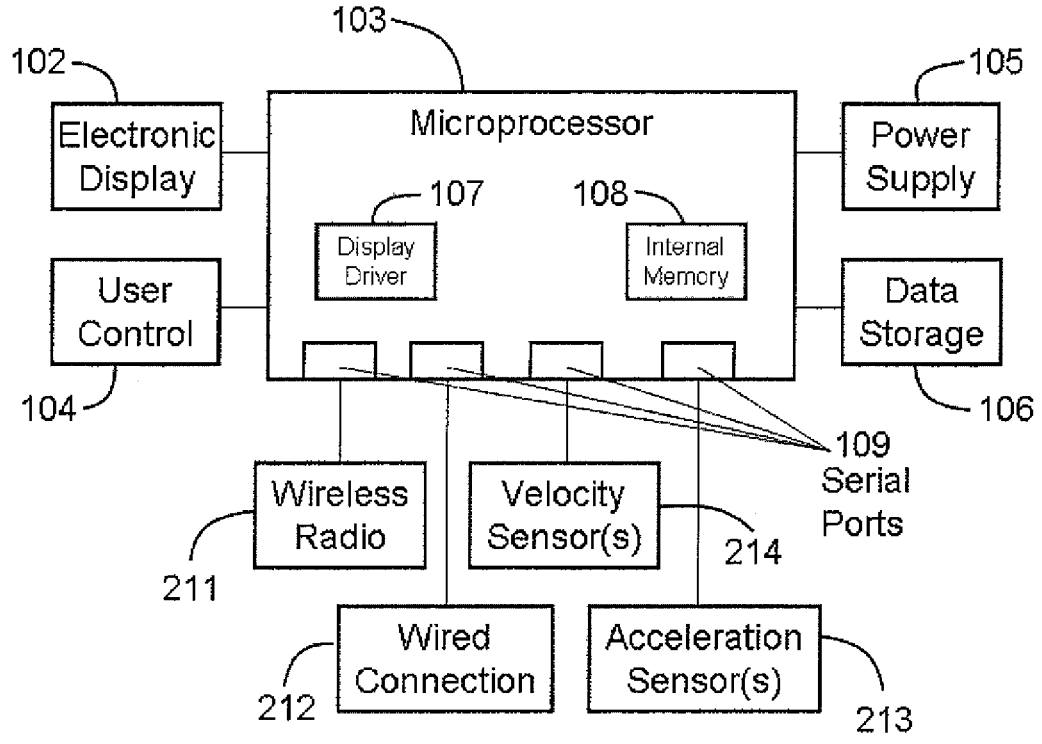

For some uses of the training device, an embodiment may be required to detect an external stimulus. For example, an instructor may wish to know how much motion of the firearm occurs when a large event like an explosion occurs nearby, to determine how steady the trainee is in such a scenario. In this case, the external stimulus would be provided by a separate device containing a microphone and filter that could send a digital signal to the microprocessor 103 via either the wireless radio 211 or the wired connection 212. An exemplary product that generates such a signal that could be redesigned for this purpose is The Clapper, manufactured by Joseph Enterprises of San Francisco, Calif. Alternatively, an instructor may wish to know how much motion occurs before, during, and after the actual action of pulling the trigger. In such a case, a trigger switch could be mounted on the firearm and toggled either intentionally by the trainee in place of a trigger pull, or mechanically or digitally linked to the actual firearm trigger so that a trigger pull also activates the external sensor. This external stimulus may be communicated to the microprocessor 103 in a variety of ways, including a direct wired connection 212 to a serial port 109 as indicated in FIG. 2B, through the wireless radio 211, or through an Ethernet port, Firewire port, parallel port, hardware interrupt mechanism, simple input pin, or any other means chosen by someone having ordinary skill in the art.

A wireless radio 211 and/or a wired connection 212 may be added to the training aid 101 to provide a communications means with other computers. The communication means can be used for a variety of purposes, including but not limited to sending updated images or movies to the training aid 101, downloading trainee performance information to the computer, or providing external stimuli to the training aid as discussed above. The wireless communication means could utilize any one or more of many common standards and protocols, including but not limited to those technologies specified by the Wi-Fi Alliance, Bluetooth Special Interest Group, ZigBee Alliance, or Infrared Data Alliance. The wireless communication means would require a wireless radio 211 as well as an antenna 232. An exemplary wireless communications device is the Broadcom BCM4330 which provides all current major Wi-Fi (IEEE 802.11a/b/g/n) protocols as well as Bluetooth 4.0 and an FM radio receiver and transmitter in a single chip. The wired communication means could utilize any one or more of many common standards and protocols for the wired connection 212, including but not limited to Universal Serial Bus, Ethernet, or Firewire, which would be directly provided by the microprocessor.

The set of software instructions that are utilized by the microprocessor at any one time may be selected from a plurality of instruction sets that are stored in microprocessor internal memory 108 or in the data storage 106, or it may be written specifically for the invention. These instruction sets could be managed as separate applications of the training aid, which could be chosen by the trainee or an instructor as needed. These various applications could be added to the training aid at any time, not just at the time of manufacture of the device. An application may be specific to a certain combination of features in a given training aid embodiment, or the application may be generically useful in all training aid embodiments. An exemplary manner of managing multiple sets of software instructions for a variety of hardware embodiments is provided by the Apple iPhone series of products.

The user interface control 104 in other embodiments may be made up of buttons, switches, directional touch pads, and touch-sensitive display screens, as examples. Each of these user interface controls may have a single function or multiple functions, and the function of a control may change depending on the software instruction set in use. Exemplary functions include a Power button 121, Next button 122, or Previous button 123 as shown in FIGS. 3A, 3B, 3C, 4A, 4C, 5, and 6B.

Figure 6A:
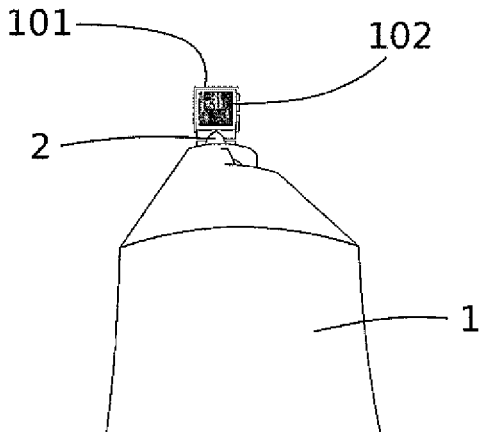
FIG. 6A provides a perspective view of the training aid while in use from the point of view of a trainee, if the aid were mounted at the end of a rifle that utilized an iron sight.
Figure 6B:
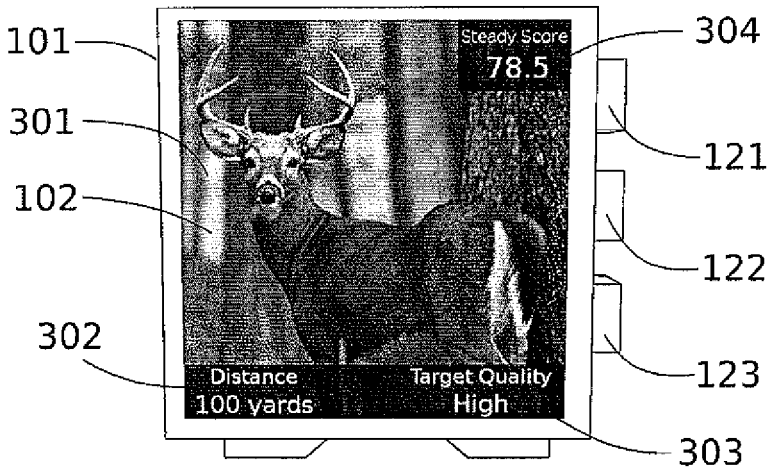
FIG. 6B provides a close up view of the training aid from the point of view of a trainee, such that particular features of one sample image on the electronic display are visible.

Illustrations of how the training aid 101, including an exemplary image on the electronic display 102, might appear to a trainee are provided in FIGS. 6A and 6B. FIG. 6A shows a near-field perspective of the training aid 101 in situ, mounted on the barrel 2 of a firearm 1, drawn as the trainee would see the combination of the training aid and the device while aiming the latter. Details of an exemplary image 301 shown on the electronic display 102 are given in FIG. 6B, in which the user controls 121, 122, and 123 are also visible. The exemplary image 301 contains elements that are meaningful in the context of two of the many possible uses of the training aid. In one use, in which the trainee is trained to quickly estimate the distance to the target and the quality of the target, the image of the deer on the exemplary image 301 is accompanied by a distance value 302 and a quality value 303. In this use, multiple images are presented sequentially to the trainee, showing the target at various distances and with varying quality levels. The quality of the electronic display 102, and consequently the quality of the images, is important for this use as the trainee must distinguish the apparent size of the target as well as particular details such as the number and structure of the antlers. In another use, in which the trainee is trained to quickly raise the firearm from a resting position, level the barrel, and eliminate all motion, a composite score for this compound motion of translations and rotations is condensed into a single number and presented to the trainee as a performance score 304. In additional embodiments, any other information of interest about the target can be displayed as in distance value 302, quality value 303, and performance score 304.

Other embodiments of the training aid could be configured to be useful with a wide variety of devices that require line-of-sight aiming, such as a long-barreled firearm (that is, a rifle or shotgun), a pistol, a large military weapon such as an anti-aircraft gun, an archery bow, a telescope, a spotting scope, or binoculars, among many other possible devices.

This invention also covers derivative works of this concept including its application in all shooting venues, including military training, personal defense, and competitive shooting, as well as embodiments for use in other applications in which line-of-sight aiming is required, such as archery, ecology and astronomy.

What is claimed:

1. A training aid for aiming a functional firearm capable of firing live ammunition, comprising a. a microprocessor, data storage, a set of software instructions, at least one electronic display, a user interface control, and at least one movement sensor capable of continuously monitoring movement of the firearm in all three translational axes and all three rotational axes in an inertial reference frame, said microprocessor communicating with the data storage, the set of software instructions, the at least one electronic display, the user interface control and the at least one movement sensor, b. a power supply, and c. a mounting mechanism, whereby, when the training aid is mounted on the firearm, a user can aim the firearm in a manner consistent with proper usage of said firearm and the training aid will present at least one electronic image to said user and will adjust the at least one electronic image to conform to the movement of the firearm detected by the at least one movement sensor.

2. The training aid as set forth in claim 1, wherein the microprocessor, the data storage, the set of software instructions, the at least one electronic display, user interface control and the at least one movement sensor are contained within a single enclosure.

3. The training aid as set forth in claim 1, wherein the training aid is configured for use with an iron sight.

4. The training aid as set forth in claim 1, wherein the training aid is configured for use with an optical sight having light refraction components.

5. The training aid as set forth in claim 1, wherein the at least one electronic display is selected from the group consisting of a liquid crystal display and a light emitting diode.

6. The training aid as set forth in claim 1, wherein the at least one electronic display has a wavelength range of at least 80 nanometers.

7. The training aid as set forth in claim 1, wherein the data storage comprises a removable memory card.

8. The training aid as set forth in claim 1, wherein the data storage comprises a plurality of data storage devices.

9. The training aid as set forth in claim 1, wherein the power supply comprises a battery or power cord.

10. The training aid as set forth in claim 1, wherein the mounting mechanism is constructed such that said training aid may be mounted on or removed from the firearm without any modification to the firearm.

11. The training aid as set forth in claim 1, wherein the mounting mechanism comprises a magnet for attachment to the firearm.

12. The training aid as set forth in claim 1, wherein the mounting mechanism utilizes friction between the training aid and the firearm by means of an element being selected from the group consisting of a hook-and-loop fastener, and a band comprised of elastic, plastic or metal.

13. The training aid as set forth in claim 1, wherein the mounting mechanism comprises a cylinder or cone that is inserted into the bore of the firearm.

14. The training aid as in claim 1, wherein the at least one electronic image is a still photo or a video.

15. The training aid as set forth in claim 1, further comprising a means of wired or wireless communication with an external device.

16. The training aid as set forth in claim 15, further comprising the wired communication being selected from the group consisting of an Ethernet port, a Firewire port, a parallel port, a hardware interrupt mechanism, and an input pin.

17. The training aid as in claim 1, further comprising at least one second sensor which communicates with the microprocessor.

18. The training aid as in claim 17, wherein the at least one movement sensor is capable of measuring acceleration or velocity of the firearm.

19. The training aid as in claim 17, wherein the set of software instructions uses information from the at least one movement sensor to move the at least one electronic image such that it appears to move in a reference frame independent of the training aid.

20. The training aid as in claim 19, wherein the set of software instructions collects information about the movement of the the firearm from the at least one movement sensor and stores this information in the data storage.

21. The training aid as in claim 19, wherein the set of software instructions collects information about the movement of the firearm from the at least one movement sensor and communicates this information to an external computer.

22. The training aid as in claim 1, wherein the at least one electronic image is accompanied by information about the simulated target.

23. A method for training a user of a functional firearm capable of firing live ammunition, comprising these steps:

(a) attaching a training aid to the firearm, said training aid comprising an electronics infrastructure comprising a microprocessor, a data storage, a set of software instructions, an electronic display, a user interface control, and at least one movement sensor capable of continuously monitoring movement of the firearm in all three translational axes and all three rotational axes in an internal reference frame, said microprocessor communicating with the data storage, the set of software instructions, the electronic display, the user interface control and the at least one movement sensor, (b) adjusting the at least one electronic image to conform to the movement of the firearm detected by the at least one movement sensor, and (c) presenting to the user at least one electronic image on the electronic display.

24. The method as in claim 23, further comprising the step of (d) comparing data from the at least one movement sensor from multiple uses of the training aid.

25. The method as in claim 23, wherein the at least one electronic image is a series of electronic images in a video.

26. The training aid as in claim 1, wherein data from the at least one movement sensor is obtained from a plurality of uses, and the data from these uses is compared.

27. The training aid as in claim 1, wherein the training aid is configured for use with a reflex sight.

28. The training aid as in claim 1, wherein the data from the use of the training aid is used to compute a performance score.

29. The training aid as in claim 1, wherein the data from the use of the training aid is used to compute a distance score.

30. The training aid as in claim 1, wherein the data from the use of the training aid is used to compute a quality score.

31. The training aid as in claim 17, wherein the at least one second sensor is a thermometer.

32. The training aid as in claim 17, wherein the at least one second sensor is a microphone.

33. The training aid as in claim 17, wherein the at least one movement sensor is a gyroscope.

34. The training aid as in claim 17, wherein the at least one second sensor is an altimeter.

35. The training aid as in claim 17, wherein the at least one second sensor is a barometer.

36. The training aid as in claim 17, further comprising a trigger switch which provides information about movement and timing of the pulling of the trigger of the firearm.

37. The training aid as in claim 4, further comprising a focal plane adjustor positioned between the light refraction components and the at least one electronic display.

38. The training aid as in claim 1, wherein the at least one movement sensor is an accelerometer.

* * * * *